US011075437B2

(12) United States Patent
Duan et al.

(10) Patent No.: US 11,075,437 B2
(45) Date of Patent: Jul. 27, 2021

(54) MOUNTING BRACKET FOR ANTENNA INFORMATION SENSING UNIT, ANTENNA INFORMATION SENSING UNIT, AND ANTENNA SYSTEM

(71) Applicant: Huawei Technologies Co., Ltd., Shenzhen (CN)

(72) Inventors: Fangqing Duan, Dongguan (CN); Mingyan Ning, Dongguan (CN); Zhiming Yang, Dongguan (CN); Hu Zhao, Shenzhen (CN); Meng Chen, Dongguan (CN); Zhuolin Cai, Dongguan (CN); Xin Feng, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/698,176

(22) Filed: Nov. 27, 2019

(65) Prior Publication Data

US 2020/0099120 A1 Mar. 26, 2020

Related U.S. Application Data

(63) Continuation of application No. PCT/CN2018/089382, filed on May 31, 2018.

(30) Foreign Application Priority Data

Jun. 2, 2017 (CN) ..... 201710409761.6

(51) Int. Cl.
*H01Q 1/22* (2006.01)

(52) U.S. Cl.
CPC ..... *H01Q 1/22* (2013.01)

(58) Field of Classification Search
CPC ..... H01Q 1/22; H01Q 1/1228; H01Q 1/246; H01Q 1/125; H01Q 1/1207; H01Q 1/12
See application file for complete search history.

(56) References Cited

U.S. PATENT DOCUMENTS 6,469,679 B2 * 10/2002 Yoshida ..... H01Q 1/125 343/892
D872,718 S * 1/2020 Bian ..... D14/238
(Continued)

FOREIGN PATENT DOCUMENTS

CN 102709668 A 10/2012
CN 205879191 U 1/2017
(Continued)

OTHER PUBLICATIONS

Azimuth Adjustment Tool 738 440, Kathrein Antennen Electronic, downloaded from http://www.ges.cz/sheets/7/738440.pdf on Mar. 23, 2020, 2 pages.

*Primary Examiner* — Brian K Young
(74) *Attorney, Agent, or Firm* — Slater Matsil, LLP

(57) ABSTRACT

A mounting bracket for an antenna information sensor unit includes a main horizontal arm, a first clamping member, and a second clamping member. The main horizontal arm is separately connected to the first clamping member and the second clamping member, and a distance between the first clamping member and the second clamping member is adjustable. The first clamping member and the second clamping member are configured to fasten the main horizontal arm on the top of an antenna, and the main horizontal arm is configured to connect to the antenna information sensor unit.

20 Claims, 9 Drawing Sheets

(56) References Cited

U.S. PATENT DOCUMENTS

| | | | | |
|---|---|---|---|---|
| 10,784,561 | B2 * | 9/2020 | Bailey | F16B 45/00 |
| D907,016 | S * | 1/2021 | He | D14/238 |
| 2017/0110780 | A1 | 4/2017 | DiPiero | |

FOREIGN PATENT DOCUMENTS

| | | | |
|---|---|---|---|
| CN | 106402617 | A | 2/2017 |
| CN | 106505290 | A | 3/2017 |
| CN | 106505291 | A | 3/2017 |

* cited by examiner

MOUNTING BRACKET FOR ANTENNA INFORMATION SENSING UNIT, ANTENNA INFORMATION SENSING UNIT, AND ANTENNA SYSTEM

CROSS-REFERENCE TO RELATED APPLICATIONS

This application is a continuation of International Application No. PCT/CN2018/089382, filed on May 31, 2018, which claims priority to Chinese Patent Application No. 201710409761.6, filed on Jun. 2, 2017. The disclosures of the aforementioned applications are hereby incorporated by reference in their entireties.

TECHNICAL FIELD

This application relates to communications technologies, and in particular, to a mounting bracket for an antenna information sensor unit, the antenna information sensor unit, and an antenna system.

BACKGROUND

As wireless communications is becoming more widespread, more users enjoying wireless communications have higher requirements on planning, design, and optimization of wireless communications networks.

During the planning, design, and optimization of the wireless communications networks, parameter information of an antenna needs to be obtained, such as mechanical tilt, azimuth, longitude and latitude, and antenna installation height. The antenna parameter information is obtained through manual measurement by using a test tool during antenna installation. However, data obtained through manual measurement during antenna installation is inaccurate, and the measurement data is prone to problems such as loss and damage when being transmitted to a network maintenance and management end. After the antenna is installed, the parameter information of the antenna may change in an environment such as strong wind and great vibration. Therefore, it is increasingly necessary to obtain real-time parameter information of an antenna during the planning, design, and optimization of the wireless communications networks.

However, the manual measurement is not accurate enough for obtaining the parameter information of the antenna during the planning, design, and optimization of the wireless communications networks.

SUMMARY

Embodiments of this application provide a mounting bracket for an antenna information sensor unit, the antenna information sensor unit, and an antenna system, to use the antenna information sensor unit disposed on an antenna to obtain parameter information of the antenna in real time.

According to a first aspect, an embodiment of this application provides a mounting bracket for an antenna information sensor unit. The mounting bracket includes a main horizontal arm, a first clamping member, and a second clamping member, where the main horizontal arm is separately connected to the first clamping member and the second clamping member, and a distance between the first clamping member and the second clamping member is adjustable, and the first clamping member and the second clamping member are configured to fasten the main horizontal arm on the top of an antenna, and the main horizontal arm is configured to connect to the antenna information sensor unit.

Parameter information of an antenna, such as mechanical tilt and azimuth, can be obtained in real time by the antenna information sensor unit disposed on the antenna by using the mounting bracket for the antenna information sensor unit provided in this implementation. In addition, different antenna dimensions may be supported because the distance between the first clamping member and the second clamping member of the mounting bracket for the antenna information sensor unit is adjustable.

With reference to the first aspect, in a possible implementation of the first aspect, the mounting bracket for the antenna information sensor unit further includes a sliding mounting arm and a first fastener, where the first clamping member is disposed at one end of the main horizontal arm, the second clamping member is disposed at one end of the sliding mounting arm, and a sliding groove for the sliding mounting arm is disposed on the main horizontal arm, and the first fastener is configured to securely connect the main horizontal arm and the sliding mounting arm when the first clamping member and the second clamping member are clamped on the antenna.

The sliding mounting arm is disposed on the mounting bracket for the antenna information sensor unit provided in this implementation, and the sliding groove for the sliding mounting arm is disposed on the main horizontal arm. In this way, the distance between the first clamping member and the second clamping member of the mounting bracket for the antenna information sensor unit can be more stably adjusted and the position is more accurate.

With reference to the first aspect or the possible implementation of the first aspect, in another possible implementation of the first aspect, both the first clamping member and the second clamping member include a rectangular fastening frame, a fastener, an L-shaped positioning plate, and a hook, one side surface of the rectangular fastening frame of the first clamping member is connected to the main horizontal arm, and one side surface of the rectangular fastening frame of the second clamping member is connected to the sliding mounting arm, a first through hole for the fastener is disposed both on the top of the rectangular fastening frames and on first folded edges of the L-shaped positioning plates of the first clamping member and the second clamping member, the first folded edge of the L-shaped positioning plate of the first clamping member is connected to the fastener of the first clamping member, the first folded edge of the L-shaped positioning plate of the first clamping member is fastened in the rectangular fastening frame of the first clamping member by using the fastener of the first clamping member, a second folded edge of the L-shaped positioning plate of the first clamping member is connected to the hook of the first clamping member, and the hook of the first clamping member is configured to be clamped on the top of the antenna, and the first folded edge of the L-shaped positioning plate of the second clamping member is connected to the fastener of the second clamping member, the first folded edge of the L-shaped positioning plate of the second clamping member is fastened in the rectangular fastening frame of the second clamping member by using the fastener of the second clamping member, a second folded edge of the L-shaped positioning plate of the second clamping member is connected to the hook of the second clamping member, and the hook of the second clamping member is configured to be clamped on the top of the antenna.

The first clamping member and the second clamping member of the mounting bracket for the antenna information sensor unit provided in this implementation use the structure in the foregoing manner, the mounting bracket for the antenna information sensor unit provided in this implementation can be more flexibly assembled, and implementation costs are low.

With reference to any one of the first aspect or the possible implementations of the first aspect, in another possible implementation of the first aspect, N guide rods are further disposed in both the rectangular fastening frames of the first clamping member and the second clamping member, both the L-shaped positioning plates of the first clamping member and the second clamping member further include N guide holes matching the guide rods, and each guide rod passes through the corresponding guide hole, where N is an integer greater than 0.

The guide rod disposed on the mounting bracket for the antenna information sensor unit provided in this implementation can act as a guide during assembling of the L-shaped positioning plate.

With reference to any one of the first aspect or the possible implementations of the first aspect, in another possible implementation of the first aspect, a groove for clamping the first clamping member is further disposed on the main horizontal arm, a clamping part is disposed on the side surface of the first clamping member, and the clamping part is connected to the groove and is configured to fasten the first clamping member on the main horizontal arm.

The groove for clamping the first clamping member is disposed on the main horizontal arm of the mounting bracket for the antenna information sensor unit provided in this implementation, and the clamping part is disposed on the side surface of the first clamping member, to implement a detachable connection between the main horizontal arm and the first clamping member.

With reference to any one of the first aspect or the possible implementations of the first aspect, in another possible implementation of the first aspect, the mounting bracket for the antenna information sensor unit further includes a first mounting vertical arm, a second mounting vertical arm, at least one second fastener, and at least one third fastener, the first clamping member is connected to the main horizontal arm by using the at least one second fastener and the first mounting vertical arm, the second clamping member is connected to the main horizontal arm by using the at least one third fastener and the second mounting vertical arm, and the at least one second fastener and the at least one third fastener are configured to fasten the main horizontal arm on the top of the antenna by using the at least one second fastener and the at least one third fastener when the first clamping member and the second clamping member are clamped on the antenna.

The distance between the first clamping member and the second clamping member of the mounting bracket for the antenna information sensor unit provided in this implementation is adjustable by adjusting the second fastener and the third fastener. Therefore, different antenna dimensions may be supported, and the antenna information sensor unit can be installed on the antenna by using the mounting bracket for the antenna information sensor unit.

With reference to any one of the first aspect or the possible implementations of the first aspect, in another possible implementation of the first aspect, a second through hole for the at least one second fastener is disposed on the first clamping member, and a third through hole for the at least one third fastener is disposed on the second clamping member, one end of the first mounting vertical arm is adjustably connected to the main horizontal arm, and the at least one second fastener passes through the second through hole and connects the first mounting vertical arm to the first clamping member, and one end of the second mounting vertical arm is adjustably connected to the main horizontal arm, and the at least one second fastener passes through the third through hole and connects the second mounting vertical arm to the second clamping member.

The distance between the first clamping member and the second clamping member of the mounting bracket for the antenna information sensor unit provided in this implementation is adjustable. Therefore, different antenna dimensions may be supported, and the antenna information sensor unit can be installed on the antenna by using the mounting bracket for the antenna information sensor unit.

With reference to any one of the first aspect or the possible implementations of the first aspect, in another possible implementation of the first aspect, the mounting bracket for the antenna information sensor unit further includes at least one clamping member, the at least one clamping member is disposed both on the second fastener and the third fastener, and the at least one clamping member is configured to securely connect the at least one second fastener to the first clamping member, and securely connect the at least one third fastener to the second clamping member.

The distance between the first clamping member and the second clamping member of the mounting bracket for the antenna information sensor unit provided in this implementation is adjustable. Therefore, different antenna dimensions may be supported, and the antenna information sensor unit can be installed on the antenna by using the mounting bracket for the antenna information sensor unit. In addition, the mounting bracket for the antenna information sensor unit is more secured by using the at least one clamping member.

With reference to any one of the first aspect or the possible implementations of the first aspect, in another possible implementation of the first aspect, a mounting base is further disposed on the main horizontal arm, and the mounting base is configured to connect to a mounting sliding part at the bottom of the antenna information sensor unit, and fasten the antenna information sensor unit on the mounting bracket for the antenna information sensor unit.

The mounting bracket for the antenna information sensor unit provided in this implementation is detachably connected to the antenna information sensor unit, and therefore the antenna information sensor unit can be separately maintained or replaced.

With reference to any one of the first aspect or the possible implementations of the first aspect, in another possible implementation of the first aspect, the mounting base includes a base and sliding grooves disposed on two sides of the base, the base is securely connected to the main horizontal arm, and the sliding grooves are configured to slide and connect to the mounting sliding part, and M threaded holes are further disposed on the base, and the M threaded holes are disposed along a horizontal direction and are configured to connect to an L-shaped spacing base of the mounting sliding part.

The mounting bracket for the antenna information sensor unit provided in this implementation is detachably connected to the antenna information sensor unit, and therefore the antenna information sensor unit can be separately maintained or replaced.

According to a second aspect, an embodiment of this application provides an antenna information sensor unit, where a mounting sliding part is disposed at the bottom of the antenna information sensor unit, and the mounting sliding part is configured to connect to a mounting base on a mounting bracket for the antenna information sensor unit, and fasten the antenna information sensor unit on the mounting bracket for the antenna information sensor unit.

Parameter information of an antenna can be obtained in real time by using the antenna information sensor unit provided in this implementation disposed on the antenna. Therefore, accurate parameter information of the antenna can be obtained during the planning, design, and optimization of wireless communications networks. In addition, the antenna information sensor unit in this embodiment is detachably connected, and therefore the antenna information sensor unit can be separately maintained or replaced.

With reference to the second aspect, in a possible implementation of the second aspect, the mounting sliding part includes a top surface and two L-shaped sliding parts, the top surface is securely connected to the antenna information sensor unit, the two L-shaped sliding parts are respectively connected to two ends of the top surface, and the two L-shaped sliding parts are configured to be slidably connected to the mounting base on the mounting bracket for the antenna information sensor unit, and the mounting sliding part further includes M L-shaped spacing bases, and the M L-shaped spacing bases are disposed in a horizontal direction and are configured to connect to threaded holes in the mounting base, where M is an integer greater than 0.

Parameter information of an antenna can be obtained in real time by using the antenna information sensor unit provided in this implementation disposed on the antenna. Therefore, accurate parameter information of the antenna can be obtained during the planning, design, and optimization of wireless communications networks. In addition, the antenna information sensor unit in this embodiment is detachably connected, and therefore the antenna information sensor unit can be separately maintained or replaced.

According to a third aspect, an embodiment of this application provides an antenna system, including an antenna, an antenna information sensor unit, and the mounting bracket for the antenna information sensor unit according to any one of the first aspect or the possible implementations of the first aspect.

For beneficial effects of the antenna system according to the third aspect, refer to beneficial effects brought by the first aspect and the possible implementations of the first aspect. Details are not described herein again.

According to a fourth aspect, an embodiment of this application provides an antenna system, including an antenna, the antenna information sensor unit according to the second aspect or one possible implementation of the second aspect, and the mounting bracket for the antenna information sensor unit according to the first aspect.

For beneficial effects of the antenna system according to the fourth aspect, refer to beneficial effects brought by the first aspect and the possible implementations of the first aspect. Details are not described herein again.

According to the mounting bracket for the antenna information sensor unit, the antenna information sensor unit, and the antenna system in the embodiments of this application, parameter information of the antenna, such as mechanical tilt and azimuth, can be obtained in real time by the antenna information sensor unit disposed on the antenna by using the mounting bracket for the antenna information sensor unit. In addition, different antenna dimensions may be supported because the distance between the first clamping member and the second clamping member of the mounting bracket for the antenna information sensor unit is adjustable.

DETAILED DESCRIPTION OF ILLUSTRATIVE EMBODIMENTS

Figure 1A:
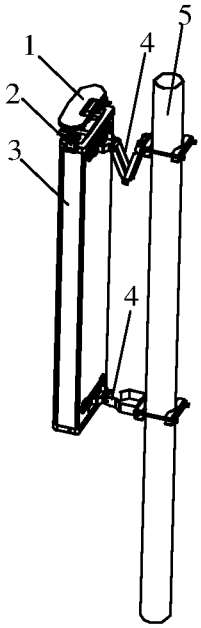
FIG. 1A is a schematic diagram of a three-dimensional structure of an antenna system according to an embodiment of this application.
Figure 1B:
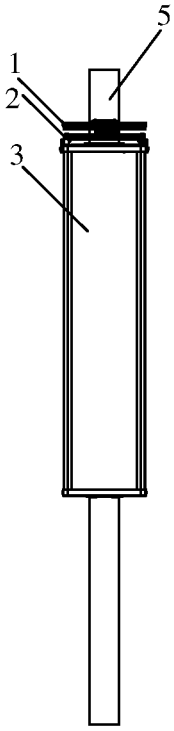
FIG. 1B is a main view of the antenna system shown in FIG. 1A.
Figure 1C:
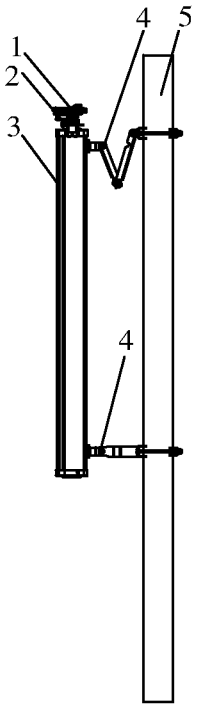
FIG. 1C is a side view of the antenna system shown in FIG. 1A.

FIG. 1A is a schematic diagram of a three-dimensional structure of an antenna system according to an embodiment of this application. FIG. 1B is a main view of the antenna system shown in FIG. 1A. FIG. 1C is a side view of the antenna system shown in FIG. 1A. As shown in FIG. 1A, FIG. 1B, and FIG. 1C, the antenna system may specifically include an antenna information sensor unit 1 (AISU), a mounting bracket 2 for the antenna information sensor unit, an antenna 3, an antenna mounting bracket 4, and an antenna pole 5. The antenna information sensor unit 1 is disposed on an upper cover of the antenna 3 by using the mounting bracket 2 for the antenna information sensor unit. In an optional connection manner, the antenna 3 is disposed on the antenna pole 5 by using the antenna mounting bracket 4. Certainly, it may be understood that the antenna may specifically be disposed in another manner. The manner described herein is merely an example and is not limited in this embodiment of this application.

The antenna information sensor unit 1 is configured to obtain parameter information of the antenna 3 in real time. The parameter information includes mechanical tilt, azimuth, longitude and latitude, antenna height, and the like. Specifically, the antenna information sensor unit 1 may include two global positioning system (GPS) antennas, an acceleration sensor, a control board, and a port. Specifically, the azimuth, longitude and latitude, and antenna height of the antenna 3 may be measured by using the two GPS antennas, and the mechanical tilt of the antenna 3 may be measured by using the acceleration sensor.

In this embodiment of this application, parameter information of the antenna 3 can be obtained in real time by the antenna information sensor unit 1 disposed on the antenna 3 by using the mounting bracket 2 for the antenna information sensor unit. Therefore, accurate parameter information of the antenna can be obtained during the planning, design, and optimization of wireless communications networks.

The following embodiments of this application describe in detail how the antenna information sensor unit 1 is specifically disposed on the antenna by using the mounting bracket 2 for the antenna information sensor unit.

Figure 2:
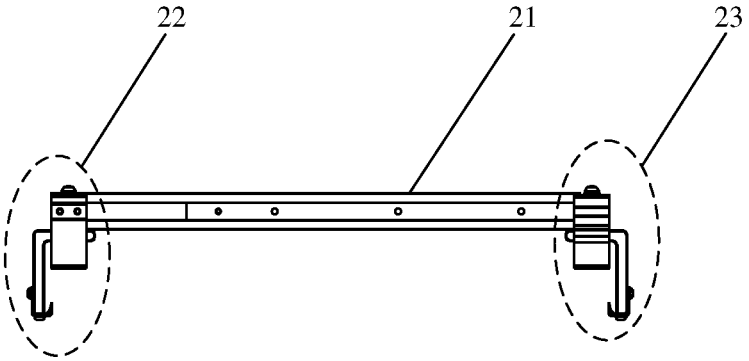
FIG. 2 is a schematic diagram of a structure of a mounting bracket 2 for an antenna information sensor unit according to an embodiment of this application.

FIG. 2 is a schematic diagram of a structure of the mounting bracket 2 for the antenna information sensor unit according to an embodiment of this application. As shown in FIG. 2, the mounting bracket 2 for the antenna information sensor unit may specifically include a main horizontal arm 21, a first clamping member 22, and a second clamping member 23. The main horizontal arm 21 is separately connected to the first clamping member 22 and the second clamping member 23. A distance between the first clamping member 22 and the second clamping member 23 is adjustable. The first clamping member 22 and the second clamping member 23 are configured to fasten the main horizontal arm 21 on the top of the antenna. The main horizontal arm 21 is configured to connect to the antenna information sensor unit 1.

Specifically, the antenna information sensor unit 1 is connected to the main horizontal arm 21. When disposing the mounting bracket for the antenna information sensor unit in this embodiment of this application on the antenna, the distance between the first clamping member 22 and the second clamping member 23 may be adjusted based on dimensions of the antenna. In addition, the first clamping member 22 and the second clamping member 23 are clamped to fasten the main horizontal arm 21 on the antenna. Therefore, parameter information of the antenna, such as mechanical tilt and azimuth, can be obtained in real time by the antenna information sensor unit disposed on the antenna. In addition, different antenna dimensions may be supported because the distance between the first clamping member 22 and the second clamping member 23 is adjustable.

Figure 3:
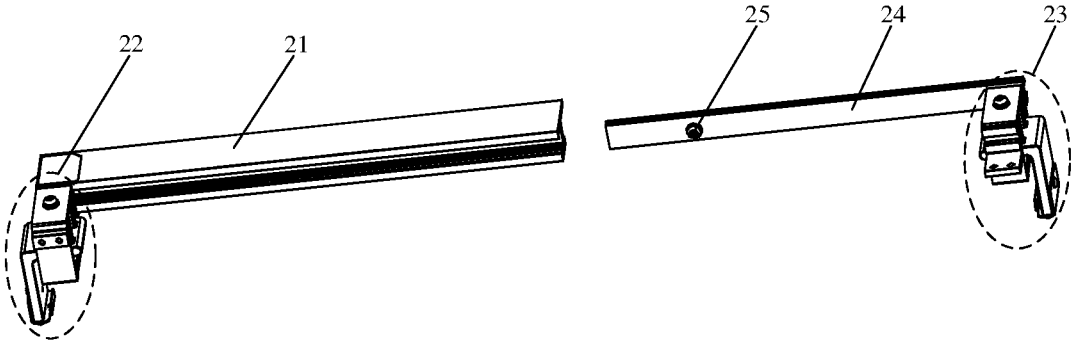
FIG. 3 is a schematic diagram of a structure of a disassembled mounting bracket 2 for an antenna information sensor unit according to an embodiment of this application.

There are many manners for implementing the adjustable distance between the first clamping member 22 and the second clamping member 23. FIG. 3 shows one implementation. For details, refer to specific description in the following embodiment.

FIG. 3 is a schematic diagram of a structure of the disassembled mounting bracket 2 for the antenna information sensor unit according to an embodiment of this application. As shown in FIG. 3, on the basis of the mounting bracket 2 for the antenna information sensor unit shown in FIG. 2, the mounting bracket 2 for the antenna information sensor unit may further include a sliding mounting arm 24 and a first fastener 25. The first clamping member 22 is disposed at one end of the main horizontal arm 21, the second clamping member 23 is disposed at one end of the sliding mounting arm 24, and a sliding groove 211 for the sliding mounting arm 24 is disposed on the main horizontal arm 21. The first fastener 25 is configured to securely connect the main horizontal arm 21 and the sliding mounting arm 24 when the first clamping member 22 and the second clamping member 23 are clamped on the antenna.

Specifically, the second clamping member 23 may be disposed at one end of the sliding mounting arm 24 in many specific manners. For example, the second clamping member 23 may be fastened at one end of the sliding mounting arm 24 by using a fastener such as a screw or a bolt. Certainly, it may be understood that the second clamping member 23 may alternatively be fastened at one end of the sliding mounting arm 24 by welding. The manners are not elaborated in this embodiment of this application. Similar to the manner of disposing the second clamping member 23, the first clamping member 22 may alternatively be fastened at one end of the main horizontal arm 21 by using a fastener such as a screw or a bolt, or by welding. The manners are not elaborated in this embodiment of this application. In this embodiment of this application, the sliding groove 211 for the sliding mounting arm 24 is disposed on the main horizontal arm 21. Therefore, the distance between the first clamping member 22 and the second clamping member 23 is adjustable by adjusting a position of the sliding mounting arm 24 in the sliding groove of the main horizontal arm 21. To be specific, the sliding mounting arm 24 is disposed in the sliding groove 211, and the position of the sliding mounting arm 24 in the sliding groove of the main horizontal arm 21 is adjusted in a pulling manner. When the sliding mounting arm 24 is adjusted to an appropriate position, the main horizontal arm and the sliding mounting arm are securely connected by using the first fastener 25. In this way, different antenna dimensions may be supported, and the antenna information sensor unit can be installed on the antenna by using the mounting bracket for the antenna information sensor unit.

Figure 4:
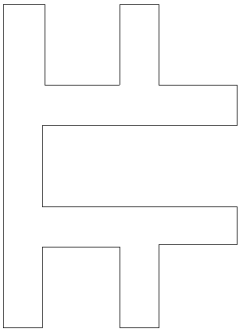
FIG. 4 is a schematic diagram of a side structure of a sliding mounting arm according to an embodiment of this application.

There may be one or more sliding grooves 211. A shape of the sliding mounting arm 24 adapts to the sliding groove of the main horizontal arm 21. For example, there are four sliding grooves 211. Any two of the sliding grooves 211 are disposed opposite to each other in a vertical direction. FIG. 4 shows a side profile of the sliding mounting arm. Four protrusions in the horizontal direction are separately clamped in the sliding groove of the main horizontal arm. In this embodiment of this application, if more sliding grooves are disposed, the distance between the first clamping member and the second clamping member of the mounting bracket for the antenna information sensor unit can be more stably adjusted and the position is more accurate.

There are many specific structures of the first clamping member 22 and the second clamping member 23, and may be flexibly selected according to a requirement. FIG. 4 is one implementation. For a specific structure, refer to the following description of this embodiment.

Figure 5A:
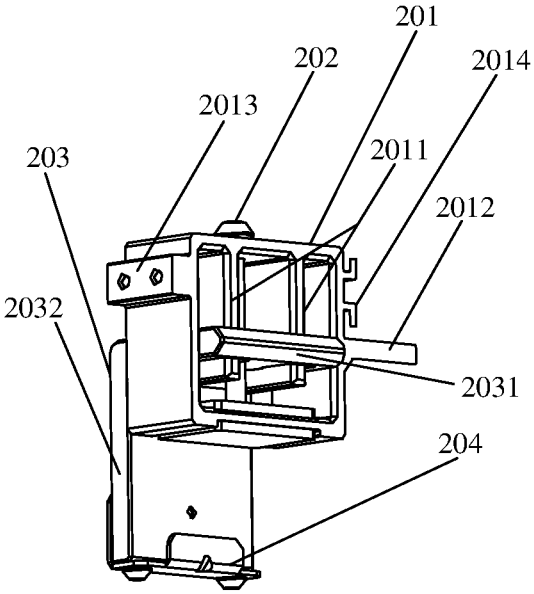
FIG. 5A is a schematic diagram of a three-dimensional structure of a clamping member according to an embodiment of this application.
Figure 5B:
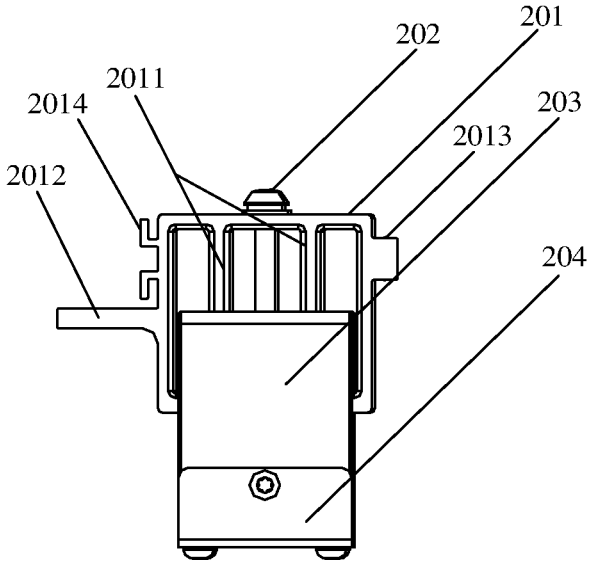
FIG. 5B is a side view of the clamping member shown in FIG. 5A.

FIG. 5A is a schematic diagram of a three-dimensional structure of a clamping member according to an embodiment of this application. FIG. 5B is a side view of the clamping member shown in FIG. 5A. The first clamping member 22 and the second clamping member 23 may use a same structure, that is, the structure shown in FIG. 5A and FIG. 5B. As shown in FIG. 5A and FIG. 5B, the clamping member (the first clamping member 22 or the second clamping member 23) may include a rectangular fastening frame 201, a fastener 202, an L-shaped positioning plate 203, and a hook 204. A first through hole for the fastener 202 is disposed on both the top of the rectangular fastening frame 201 and a first folded edge 2031 of the L-shaped positioning plate 203. The first folded edge 2031 is connected to the fastener 202, and is fastened in the rectangular fastening frame 201 by using the fastener 202. A second folded edge 2032 of the L-shaped positioning plate 203 is connected to the hook 204. The hook 204 is configured to be clamped on the top of the antenna.

The L-shaped positioning plate 203 and the hook 204 may be integrated, or the hook 204 may be fastened on the second folded edge 2032 of the L-shaped positioning plate 203 by using a screw, as shown in FIG. 5A and FIG. 5B. A knife edge of the hook 204 may be clamped between the upper cover of the antenna and a radome. The mounting bracket for the antenna information sensor unit in this embodiment of this application is fastened on the antenna by using the two clamping members. To be specific, the two clamping members are respectively clamped on two sides of the top of the antenna. The position of the L-shaped positioning plate 203 in the rectangular fastening frame 201 is adjusted by rotating the fastener 202, so that a bottom surface of the rectangular fastening frame 201 comes into contact with the top of the antenna. In other words, the fastener 202 may be connected to the L-shaped positioning plate 203 in a threaded connection manner, and a position of the L-shaped positioning plate 203 may be lifted or lowered by rotating the fastener 202, to adapt to radomes in different dimensions.

Optionally, N guide rods 2011 are further disposed in the rectangular fastening frame 201, the L-shaped positioning plate 203 further includes N guide holes matching the guide rods 2011, and each guide rod 2011 passes through the corresponding guide hole. N is an integer greater than 0. The guide rod may act as a guide when the L-shaped positioning plate 203 is assembled.

It can be seen from FIG. 5A that, an upper end of the guide rod 2011 is connected to the top of the rectangular fastening frame 201, and a lower end of the guide rod 2011 and the bottom of the rectangular fastening frame 201 are not connected and are spaced at a preset distance. The L-shaped positioning plate 203 is disposed in the rectangular fastening frame 201 at the preset spacing distance. In other words, components of the clamping member are detachable in this embodiment.

It should be noted that both the first clamping member 22 and the second clamping member 23 in this embodiment of this application may be the clamping member shown in FIG. 5A and FIG. 5B. The first clamping member 22 is connected to the main horizontal arm 21, the second clamping member 23 is connected to the sliding mounting arm 24, and the main horizontal arm 21 and the sliding mounting arm 24 have different structures. Therefore, a clamping part 2014 is disposed on one side surface of the rectangular fastening frame 201 of the clamping member shown in FIG. 5A and FIG. 5B, and a connection part 2013 is disposed on the other side surface.

The clamping part 2014 is connected to the main horizontal arm 21, in other words, the clamping part is used as the first clamping member. Optionally, a groove may be further disposed on the main horizontal arm 21. The clamping part 2014 is connected to the groove to fasten the first clamping member on the main horizontal arm 21. In another implementation, the clamping part 2014 may be disposed in the sliding groove 211 of the main horizontal arm. This is not limited in this embodiment of this application. Optionally, a fastening part 2012 may be further disposed below the clamping part 2014. A through hole is disposed on the fastening part 2012, and the first clamping member is further fastened by using a screw.

The connection part 2013 is connected to the sliding mounting arm 24, in other words, the clamping member is used as the second clamping member. In an optional implementation, at least one through hole is disposed on the connection part 2013, and the connection part 2013 is connected to the sliding mounting arm 24 by using a screw.

The clamping member in this embodiment of this application uses the structure shown in FIG. 5A and FIG. 5B. Therefore, assembly of the mounting bracket for the antenna information sensor unit in this embodiment of this application is more flexible, and implementation costs are low.

Figure 6A:
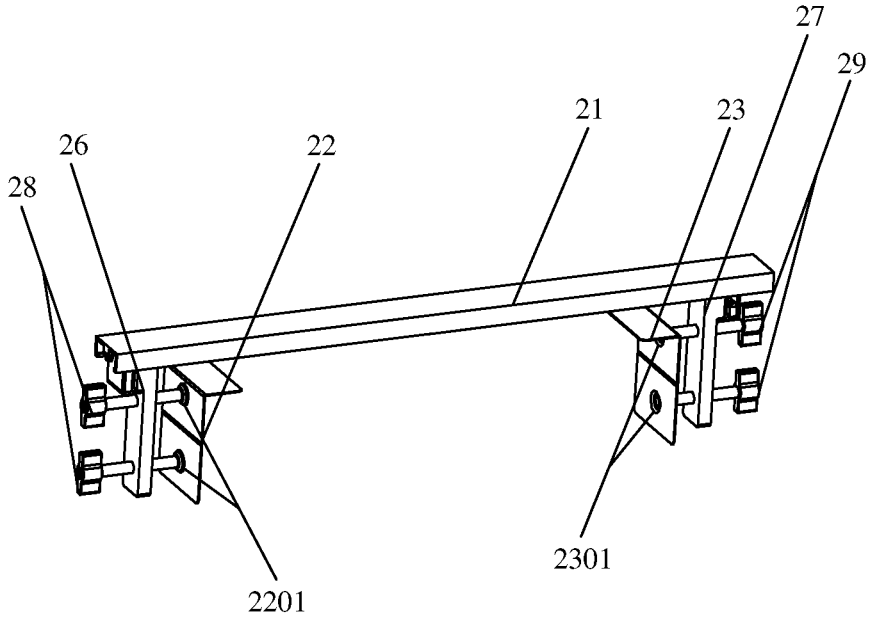
FIG. 6A is a schematic diagram of a three-dimensional structure of another mounting bracket 2 for an antenna information sensor unit according to an embodiment of this application.
Figure 6B:
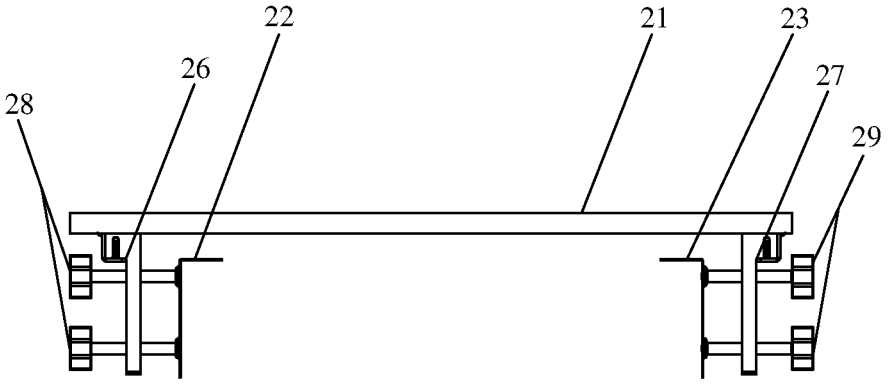
FIG. 6B is a schematic side view of the mounting bracket 2 for the antenna information sensor unit shown in FIG. 6A.

FIG. 6A and FIG. 6B are another manner in which the distance between the first clamping member 22 and the second clamping member 23 is adjustable. For a specific implementation, refer to the description in the following embodiment.

FIG. 6A is a schematic diagram of a three-dimensional structure of another mounting bracket 2 for the antenna information sensor unit according to an embodiment of this application. FIG. 6B is a schematic side view of the mounting bracket 2 for the antenna information sensor unit shown in FIG. 6A. As shown in FIG. 6A and FIG. 6B, the mounting bracket for the antenna information sensor unit in this embodiment includes the main horizontal arm 21, the first clamping member 22, the second clamping member 23, a first mounting vertical arm 26, a second mounting vertical arm 27, at least one second fastener 28, and at least one third fastener 28. The first clamping member 22 is connected to the main horizontal arm 21 by using the at least one second fastener 28 and the first mounting vertical arm 26. The second clamping member 23 is connected to the main horizontal arm 21 by using the at least one third fastener 29 and the second mounting vertical arm 27. The at least one second fastener 28 and the at least one third fastener 29 are configured to fasten the main horizontal arm 21 on the top of the antenna by using the at least one second fastener 28 and the at least one third fastener 29 when the first clamping member 22 and the second clamping member 23 are clamped on the antenna.

It should be noted that, the first mounting vertical arm 26 and the second mounting vertical arm 27 may also be adjusted. If the first mounting vertical arm 26 and the second mounting vertical arm 27 need to be greatly adjusted, adjust them on the main horizontal arm. If the first mounting vertical arm 26 and the second mounting vertical arm 27 need to be slightly adjusted, adjust them by using the second fastener 28 or the third fastener 29. The second fastener and the third fastener may specifically be adjustable handles.

In one implementation, a second through hole 2201 for the at least one second fastener 28 is disposed on the first clamping member 22, and a third through hole 2301 for the at least one third fastener 29 is disposed on the second clamping member 23. One end of the first mounting vertical arm 26 is adjustably connected to the main horizontal arm 21, and the at least one second fastener 28 passes through the second through hole 2201 and connects the first mounting vertical arm 26 to the first clamping member 22. One end of the second mounting vertical arm 29 is adjustably connected to the main horizontal arm 21, and the at least one third fastener 29 passes through the third through hole 2301 and connects the second mounting vertical arm 27 to the second clamping member 23.

Optionally, the mounting bracket 2 for the antenna information sensor unit further includes at least one clamping member. The at least one clamping member is disposed both on the second fastener and the third fastener. The at least one clamping member is configured to securely connect the at least one second fastener to the first clamping member, and securely connect the at least one third fastener to the second clamping member.

In this embodiment of this application, the second fastener and the third fastener are disposed, so that the distance between the first clamping member 22 and the second clamping member 23 is adjustable by adjusting the second fastener and the third fastener. Therefore, different antenna dimensions may be supported, and the antenna information sensor unit can be installed on the antenna by using the mounting bracket for the antenna information sensor unit.

According to the foregoing embodiments, the mounting bracket 2 for the antenna information sensor unit and the antenna information sensor unit 1 may be connected in many manners. To implement detachable connection of the antenna information sensor unit to facilitate separate maintenance or replacement of the antenna information sensor unit, in this embodiment of this application, a mounting base may be further disposed on the mounting bracket for the antenna information sensor unit in the foregoing embodiments. For details, refer to the description in the following embodiment.

Figure 7A:
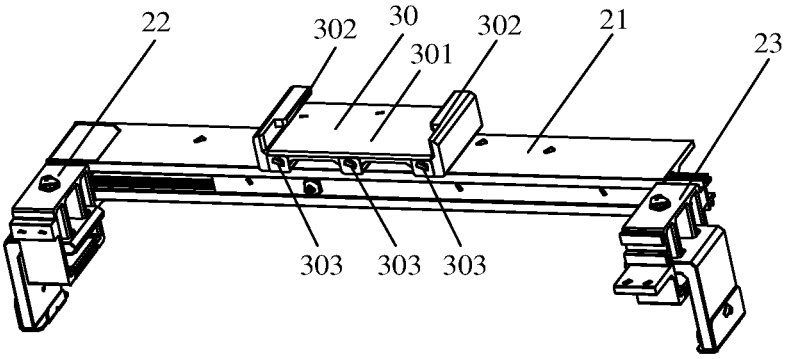
FIG. 7A is a schematic diagram of a three-dimensional structure of another mounting bracket for an antenna information sensor unit according to an embodiment of this application.
Figure 7B:
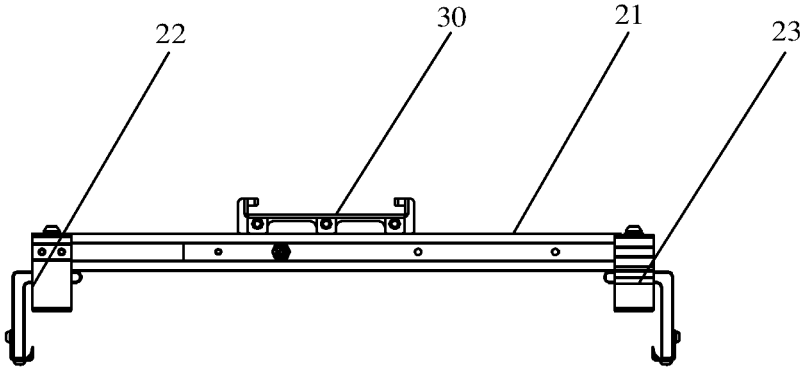
FIG. 7B is a main view of the mounting bracket for the antenna information sensor unit shown in FIG. 7A.
Figure 7C:
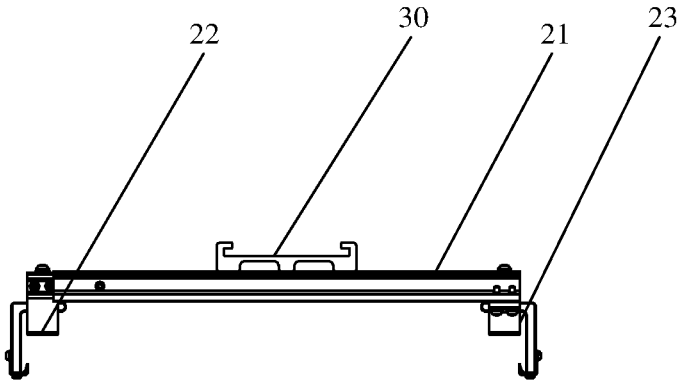
FIG. 7C is a rear view of the mounting bracket for the antenna information sensor unit shown in FIG. 7A.

FIG. 7A is a schematic diagram of a three-dimensional structure of another mounting bracket for an antenna information sensor unit according to an embodiment of this application. FIG. 7B is a main view of the mounting bracket for the antenna information sensor unit shown in FIG. 7A. FIG. 7C is a rear view of the mounting bracket for the antenna information sensor unit shown in FIG. 7A. As shown in FIG. 7A to FIG. 7C, a mounting base 30 is further disposed on the main horizontal arm 21. The mounting base 30 is configured to connect to a mounting sliding part at the bottom of the antenna information sensor unit, and fasten the antenna information sensor unit 1 on the mounting bracket 2 for the antenna information sensor unit.

In an optional implementation, the mounting base includes a base 301 and sliding grooves 302 disposed on two sides of the base as shown in FIG. 7A. The base 301 is securely connected to the main horizontal arm 21, and the sliding grooves 302 are configured to slide and connect to the mounting sliding part. M threaded holes 303 are further disposed on the base. The M threaded holes 303 are disposed along a horizontal direction and are configured to connect to an L-shaped spacing base of the mounting sliding part.

The mounting bracket for the antenna information sensor unit in this embodiment is detachably connected to the antenna information sensor unit, and therefore the antenna information sensor unit can be separately maintained or replaced.

Figure 8A:
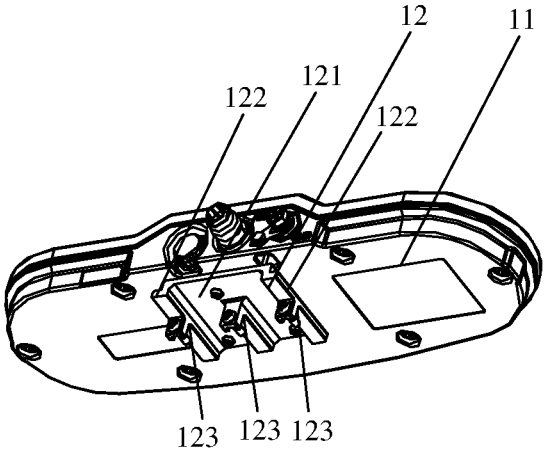
FIG. 8A is a schematic diagram of a three-dimensional structure of an antenna information sensor unit according to an embodiment of this application.
Figure 8B:
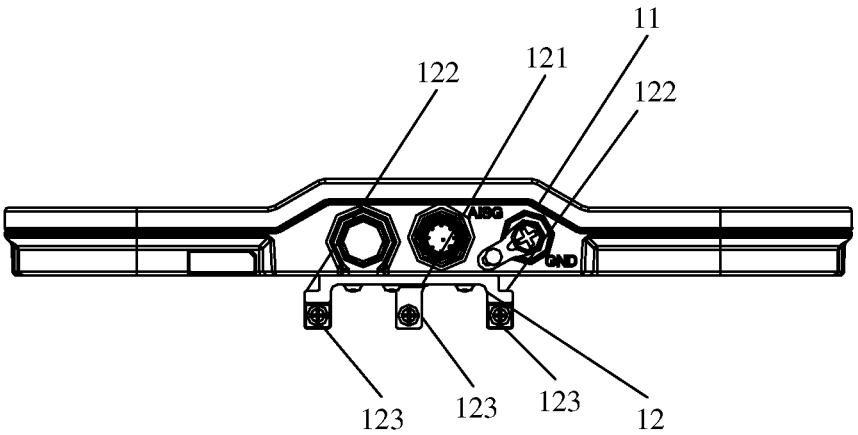
FIG. 8B is a main view of the antenna information sensor unit shown in FIG. 8A.
Figure 8C:
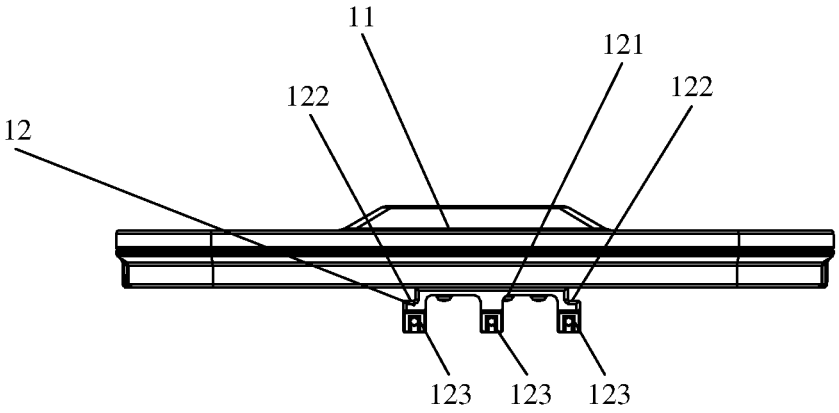
FIG. 8C is a rear view of the antenna information sensor unit shown in FIG. 8A.

FIG. 8A is a schematic diagram of a three-dimensional structure of an antenna information sensor unit according to an embodiment of this application. FIG. 8B is a main view of the antenna information sensor unit shown in FIG. 8A. FIG. 8C is a rear view of the antenna information sensor unit shown in FIG. 8A. As shown in FIG. 8A to FIG. 8C, the antenna information sensor unit may include an antenna information sensor unit body 11 and a mounting sliding part 12. The mounting sliding part 12 is disposed at the bottom of the antenna information sensor unit body 11. The mounting sliding part 12 is configured to connect to the mounting base 30 on the mounting bracket 2 for the antenna information sensor unit, and fasten the antenna information sensor unit body 11 on the mounting bracket 2 for the antenna information sensor unit.

Optionally, the mounting sliding part 12 may include a top surface 121 and two L-shaped sliding parts 122. The top surface 121 is securely connected to the antenna information sensor unit body 11. The two L-shaped sliding parts are respectively connected to two ends of the top surface, and are configured to be slidably connected to the mounting base 30 on the mounting bracket 2 for the antenna information sensor unit. The mounting sliding part 12 may further include M L-shaped spacing bases 123. The M L-shaped spacing bases 123 are disposed in a horizontal direction and are configured to connect to threaded holes in the mounting base 30. The L-shaped spacing base 123 may specifically include an L-shaped spacing body and a fastener. A through hole for the fastener is disposed in the L-shaped spacing body. The fastener may be a screw. The fastener may be connected to the threaded hole 303.

In this embodiment of this application, parameter information of the antenna 3 can be obtained in real time by the antenna information sensor unit disposed on the antenna. Therefore, accurate parameter information of the antenna can be obtained during the planning, design, and optimization of wireless communications networks.

In addition, the antenna information sensor unit in this embodiment is detachably connected, and therefore the antenna information sensor unit can be separately maintained or replaced.

Figure 9A:
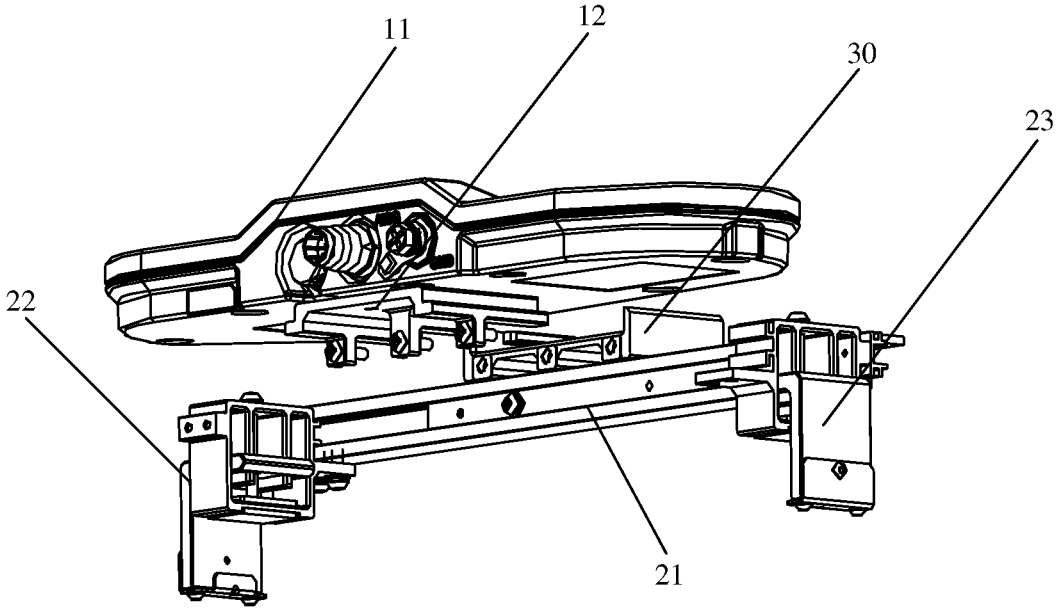
FIG. 9A is a schematic diagram of assembly of a mounting bracket for an antenna information sensor unit and the antenna information sensor unit according to an embodiment of this application.
Figure 9B:
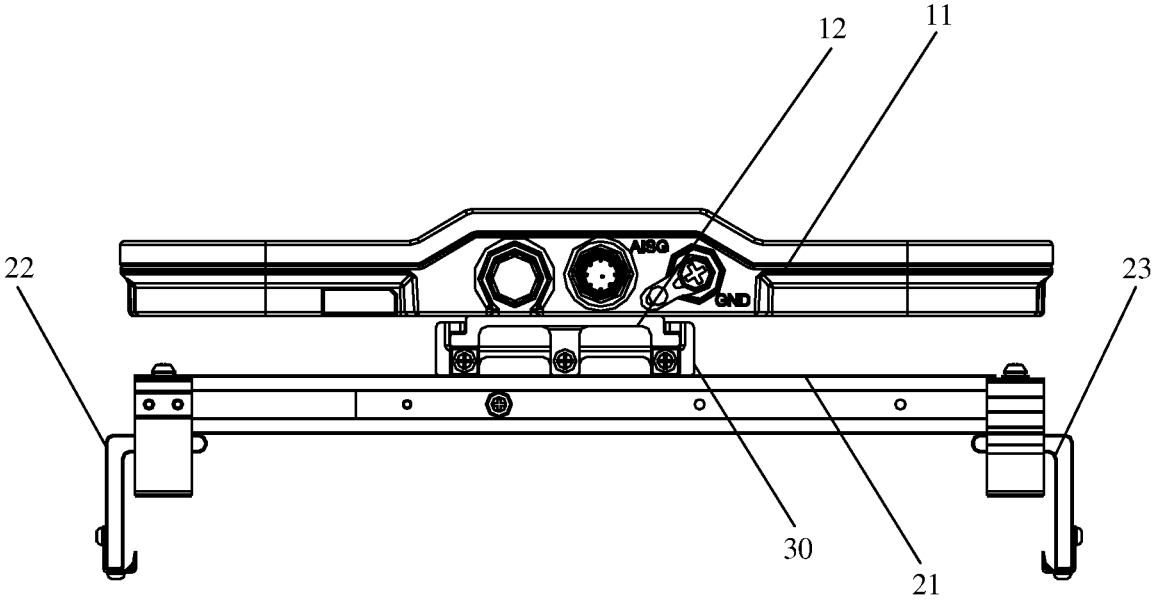
FIG. 9B is a main view of a completed assembly according to an embodiment of this application.
Figure 9C:
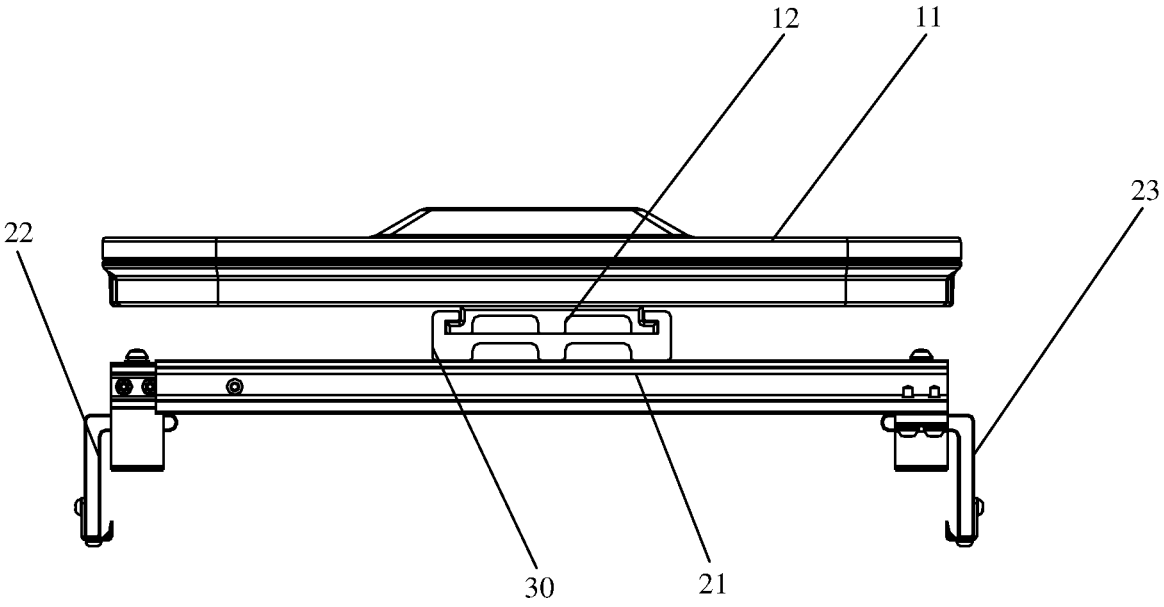
FIG. 9C is a rear view of a completed assembly according to an embodiment of this application.

FIG. 9A is a schematic diagram of assembly of a mounting bracket for an antenna information sensor unit and the antenna information sensor unit according to an embodiment of this application. FIG. 9B is a main view of a completed assembly according to an embodiment of this application. FIG. 9C is a rear view of a completed assembly according to an embodiment of this application. As shown in FIG. 9A to FIG. 9C, the mounting bracket for the antenna information sensor unit specifically uses the mounting bracket structure for the antenna information sensor unit shown in FIG. 7A to FIG. 7C, and the antenna information sensor unit specifically uses the antenna information sensor unit structure shown in FIG. 8A to FIG. 8C. As shown in FIG. 9A, during assembly, the mounting sliding part 12 at the bottom of the antenna information sensor unit may be slidably installed into the mounting base 30 of the mounting bracket for the antenna information sensor unit, and may be fastened by using screws.

Figure 10:
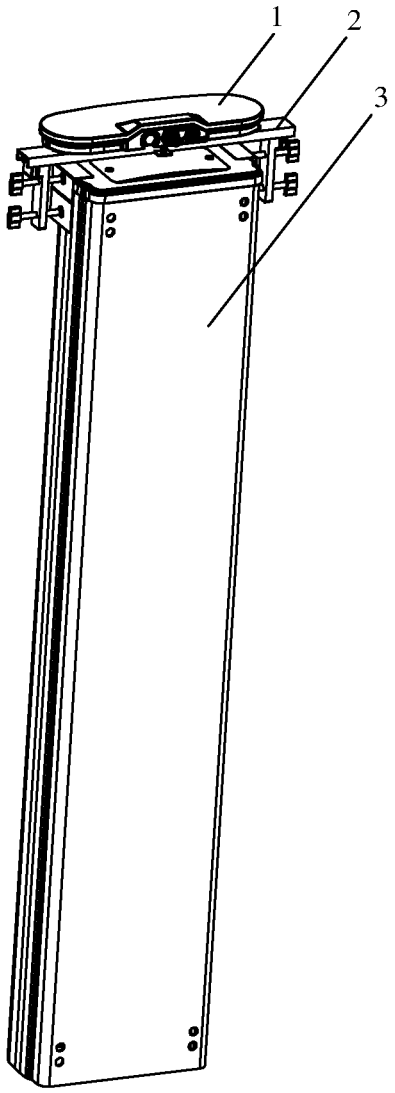
FIG. 10 is a schematic diagram of a structure of another antenna system according to an embodiment of this application.

FIG. 10 is a schematic diagram of a structure of another antenna system according to an embodiment of this application. As shown in FIG. 10, the antenna system includes the antenna 3, the antenna information sensor unit 1, and the mounting bracket 2 for the antenna information sensor unit. The mounting bracket for the antenna information sensor unit uses a structure shown in FIG. 6A and FIG. 6B. Implementation principles and technical effects are similar, and details are not described herein again.

Finally, it should be noted that the foregoing embodiments are merely intended for describing the technical solutions of this application other than limiting this application. Although this application is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of this application.

What is claimed is:

1. A mounting bracket for an antenna information sensor unit, comprising:

a main horizontal arm;

a first clamping member; and a second clamping member;

wherein the main horizontal arm is separately connected to the first clamping member on a first end of the main horizontal arm, and separately connected to the second clamping member on a second end of the main horizontal arm, and a distance between the first clamping member and the second clamping member is adjustable; and wherein the first clamping member and the second clamping member are configured to fasten the main horizontal arm on top of an antenna, and wherein the main horizontal arm is configured to connect to the antenna information sensor unit.

2. The mounting bracket according to claim 1, wherein the mounting bracket for the antenna information sensor unit further comprises:

a sliding mounting arm; and a first fastener;

wherein the first clamping member is disposed at one end of the main horizontal arm, the second clamping member is disposed at one end of the sliding mounting arm, and a sliding groove for the sliding mounting arm is disposed on the main horizontal arm; and wherein the first fastener is configured to securely connect the main horizontal arm to the sliding mounting arm when the first clamping member and the second clamping member are clamped on the antenna.

3. The mounting bracket according to claim 2, wherein the first clamping member and the second clamping member each comprise a rectangular fastening frame, a fastener, an L-shaped positioning plate, and a hook;

wherein one side surface of the rectangular fastening frame of the first clamping member is connected to the main horizontal arm, and one side surface of the rectangular fastening frame of the second clamping member is connected to the sliding mounting arm; and wherein a respective first through hole for the respective fastener is disposed on top of a respective one of the rectangular fastening frames and on a respective first folded the rectangular fastening frames of each of the first clamping member and the second clamping member, wherein each of the L-shaped positioning plates of the first clamping member and the second clamping member further comprises N guide holes matching guide rods, and wherein each guide rod passes through a corresponding guide hole, and wherein N is an integer greater than 0.

4. The mounting bracket according to claim 3, wherein N guide rods are disposed in the rectangular fastening frames of each of the first clamping member and the second clamping member, wherein each of the L-shaped positioning plates of the first clamping member and the second clamping member further comprises N guide holes matching the guide rods, and wherein each guide rod passes through a corresponding guide hole, and wherein N is an integer greater than 0.

5. The mounting bracket according to claim 2, wherein a groove for clamping the first clamping member is disposed on the main horizontal arm, wherein a clamping part is disposed on a side surface of the first clamping member, and wherein the clamping part is connected to the groove and is configured to fasten the first clamping member on the main horizontal arm.

6. The mounting bracket according to claim 1, further comprising:

a first mounting vertical arm;

a second mounting vertical arm;

at least one second fastener; and at least one third fastener;

wherein the first clamping member is connected to the main horizontal arm by the at least one second fastener and the first mounting vertical arm;

wherein the second clamping member is connected to the main horizontal arm by the at least one third fastener and the second mounting vertical arm; and wherein the at least one second fastener and the at least one third fastener are configured to fasten the main horizontal arm on the top of the antenna when the first clamping member and the second clamping member are clamped on the antenna.

7. The mounting bracket according to claim 6, wherein a second through hole for the at least one second fastener is disposed on the first clamping member, and wherein a third through hole for the at least one third fastener is disposed on the second clamping member;

wherein one end of the first mounting vertical arm is adjustably connected to the main horizontal arm, and wherein the at least one second fastener passes through the second through hole and connects the first mounting vertical arm to the first clamping member; and wherein one end of the second mounting vertical arm is adjustably connected to the main horizontal arm, and the at least one second fastener passes through the third through hole and connects the second mounting vertical arm to the second clamping member.

8. The mounting bracket according to claim 7, wherein the mounting bracket for the antenna information sensor unit further comprises at least one third clamping member, wherein the at least one clamping member is disposed both on the second fastener and the third fastener, and wherein the at least one third clamping member is configured to securely connect the at least one second fastener to the first clamping member, and further to securely connect the at least one third fastener to the second clamping member.

9. The mounting bracket according to claim 1, wherein a mounting base is further disposed on the main horizontal arm, and wherein the mounting base is configured to connect to a mounting sliding part at the bottom of the antenna information sensor unit, and further to fasten the antenna information sensor unit on the mounting bracket for the antenna information sensor unit.

10. The mounting bracket according to claim 9, wherein the mounting base comprises a base and sliding grooves disposed on two sides of the base, wherein the base is securely connected to the main horizontal arm, and wherein the sliding grooves are configured to slide and connect to the mounting sliding part; and wherein M threaded holes are further disposed on the base, and wherein the M threaded holes are disposed along a horizontal direction and are configured to connect to an L-shaped spacing base of the mounting sliding part.

11. An apparatus, comprising:

a main horizontal arm;

a first clamping member connected to a first end of the main horizontal arm and having a first fastening frame connected to the main horizontal arm, further having a first positioning plate, and further having a first hook connected to a first positioning frame by the first positioning plate and extending from the first positioning plate; and a second clamping member that is adjustably connected to the main horizontal arm and that is adjustable with respect to a spacing between the first clamping member and the second clamping member, the second clamping member having a second fastening frame that is adjustably connected to the main horizontal arm, further having a second positioning plate, and further having a second hook connected to a second positioning frame by the second positioning plate and extending from the second positioning plate toward the first hook, and wherein the first hook extends toward the second hook.

12. The apparatus according to claim 11, further comprising:

a sliding mounting arm; and a first fastener;

wherein the second clamping member is disposed at a first end of the sliding mounting arm, and wherein the main horizontal arm has a sliding groove, and the sliding mounting arm slideably extends into the sliding groove; and wherein the first fastener secures the main horizontal arm to the sliding mounting arm.

13. The apparatus according to claim 12, wherein the first fastening frame and the second fastening frame are each rectangular, and wherein the first positioning plate and the second positioning plate are L-shaped;

wherein the first fastening frame has a first through hole, and wherein a first frame fastener extends through the first through hole and through a first folded edge of the first positioning plate and connects the first positioning plate within the first fastening frame, wherein the first hook is disposed on an end surface of a second folded edge of the first positioning plate; and wherein the second fastening frame has a second through hole, and wherein a second frame fastener extends through the second through hole and through a third folded edge of the second positioning plate and connects the second positioning plate within the second fastening frame, and wherein the second hook is disposed on an end surface of a fourth folded edge of the second positioning plate.

14. The apparatus according to claim 13, wherein the first fastening frame has one or more first guide rods disposed therein and extending through one or more corresponding first guide holes in the first folded edge of the first positioning plate; and wherein the second fastening frame has one or more second guide rods disposed therein and extending through one or more corresponding second guide holes in the third folded edge of the second positioning plate.

15. The apparatus according to claim 12, wherein the first fastening frame comprises a first clamping part disposed on an outside side surface of the first fastening frame and at least partially engages with a clamping groove on the main horizontal arm.

16. An apparatus, comprising:

a main horizontal arm;

a first mounting vertical arm adjustably connected to the main horizontal arm;

a second mounting vertical arm adjustably connected to the main horizontal arm;

at least one second fastener extending through the first mounting vertical arm;

at least one third fastener extending through the second mounting vertical arm;

a first clamping member that is adjustably connected by the at least one second fastener to the first mounting vertical arm; and a second clamping member that is adjustably connected by the at least one third fastener to the to the second vertical mounting arm and that is adjustable with respect to a spacing between the first clamping member and the second clamping member by adjustment of the third fastener, and wherein the first clamping member is adjustable with respect to the spacing between the first clamping member and the second clamping member by adjustment of the second fastener.

17. The apparatus according to claim 16, further comprising at least one third clamping member, wherein the at least one third clamping member is disposed both on the second fastener and the third fastener, and wherein the at least one third clamping member connects the at least one second fastener to the first clamping member, and connects the at least one third fastener to the second clamping member.

18. The apparatus according to claim 16, further comprising a mounting base is disposed on the main horizontal arm, and the mounting base is configured to receive a mounting sliding part at a bottom of an antenna information sensor unit, and connect the antenna information sensor unit to a mounting bracket.

19. The apparatus according to claim 18, wherein the mounting base comprises a base and sliding grooves disposed on two sides of the base, wherein the base is connected to the main horizontal arm, and wherein the sliding grooves are engaged with the mounting sliding part; and wherein M threaded holes are further disposed on the base, and wherein the M threaded holes are disposed along a horizontal direction and are connected to an L-shaped spacing base of the mounting sliding part.

20. The apparatus according to claim 19, wherein the apparatus is deposed on an upper cover of a wireless communication antenna with the first clamping member and second clamping member disposed on opposite sides of the upper cover the wireless communication antenna, and wherein an antenna information sensor unit is mounted to the mounting base with the apparatus securing the antenna information sensor unit to the upper cover of the wireless communication antenna.

* * * * *